US010507890B1

(12) United States Patent
Lottman

(10) Patent No.: US 10,507,890 B1
(45) Date of Patent: Dec. 17, 2019

(54) FLAT BOTTOM BOAT

(71) Applicant: Matt Lottman, Piquot Lakes, MN (US)

(72) Inventor: Matt Lottman, Piquot Lakes, MN (US)

( * ) Notice: Subject to any disclaimer, the term of this patent is extended or adjusted under 35 U.S.C. 154(b) by 0 days.

(21) Appl. No.: 15/975,508

(22) Filed: May 9, 2018

Related U.S. Application Data

(60) Provisional application No. 62/523,288, filed on Jun. 22, 2017.

(51) Int. Cl.
*B63B 1/04* (2006.01)
*B63B 3/18* (2006.01)

(52) U.S. Cl.
CPC ..... *B63B 3/185* (2013.01); *B63B 1/04* (2013.01); *B63B 2241/02* (2013.01)

(58) Field of Classification Search
CPC ..... B63B 3/185; B63B 1/04; B63B 2241/02
USPC ..... 114/63
See application file for complete search history.

(56) References Cited

U.S. PATENT DOCUMENTS

| | | | | |
|---|---|---|---|---|
| 3,831,212 A * | 8/1974 | Moore | B63B 3/20 | 114/357 |
| 3,964,417 A * | 6/1976 | Williams | B63B 1/20 | 114/274 |
| 4,011,826 A * | 3/1977 | Yee | B63B 5/14 | 114/26 |
| 8,757,085 B1 * | 6/2014 | Cain | B63B 3/09 | 114/355 |

* cited by examiner

*Primary Examiner* — Stephen P Avila
(74) *Attorney, Agent, or Firm* — Moss & Barnett; Michael A. Bondi

(57) ABSTRACT

A flat bottom boat including an upper hull portion and a lower hull portion. The upper hull portion has a first width and a lower surface. The lower hull portion has a second width that is less than a first width. The lower hull portion extends from a lower edge of the upper hull portion. A lower surface of the lower hull portion is substantially flat.

18 Claims, 5 Drawing Sheets

12

FLAT BOTTOM BOAT

REFERENCE TO RELATED APPLICATION

This application claims priority to Provisional Applic. No. 62/523,288, filed on Jun. 22, 2017, the contents of which are incorporated herein by reference.

FIELD OF THE INVENTION

The invention relates to watercrafts. More particularly, the invention relates to flat bottom boats.

SUMMARY OF THE INVENTION

An embodiment of the invention is directed to a flat bottom boat having an upper hull portion and a lower hull portion. The upper hull portion has a first width and a lower surface. The lower hull portion has a second width that is less than a first width. The lower hull portion extends from a lower edge of the upper hull portion. A lower surface of the lower hull portion is substantially flat.

Another embodiment of the invention is directed to a flat bottom boat that includes an upper hull portion and a lower hull portion. The upper hull portion has a first width, a lower surface, a first side surface and a second side surface that is opposite the first side surface. The lower hull portion has a second width that is less than a first width. The lower hull portion extends from a lower edge of the upper hull portion. A lower surface of the lower hull portion is substantially flat. The lower hull portion is stepped from the first side surface and the second side surface to define a first stepped region and a second stepped region. The first stepped region is approximately equal to the second stepped region.

Another embodiment of the invention is directed to a flat bottom boat having an upper hull portion and a lower hull portion. The upper hull portion has a first width and a lower surface. The lower hull portion has a second width that is less than a first width. The lower hull portion extends from a lower edge of the upper hull portion. A lower surface of the lower hull portion is substantially flat. The upper hull portion includes a first side surface and a second side surface that is opposite the first side surface. The lower hull portion is stepped from the first side surface and the second side surface to define a first stepped region and a second stepped region. A width of each of the first stepped region and the second stepped region is between about 70 percent and about 130 percent of a height of the lower hull portion.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 1:
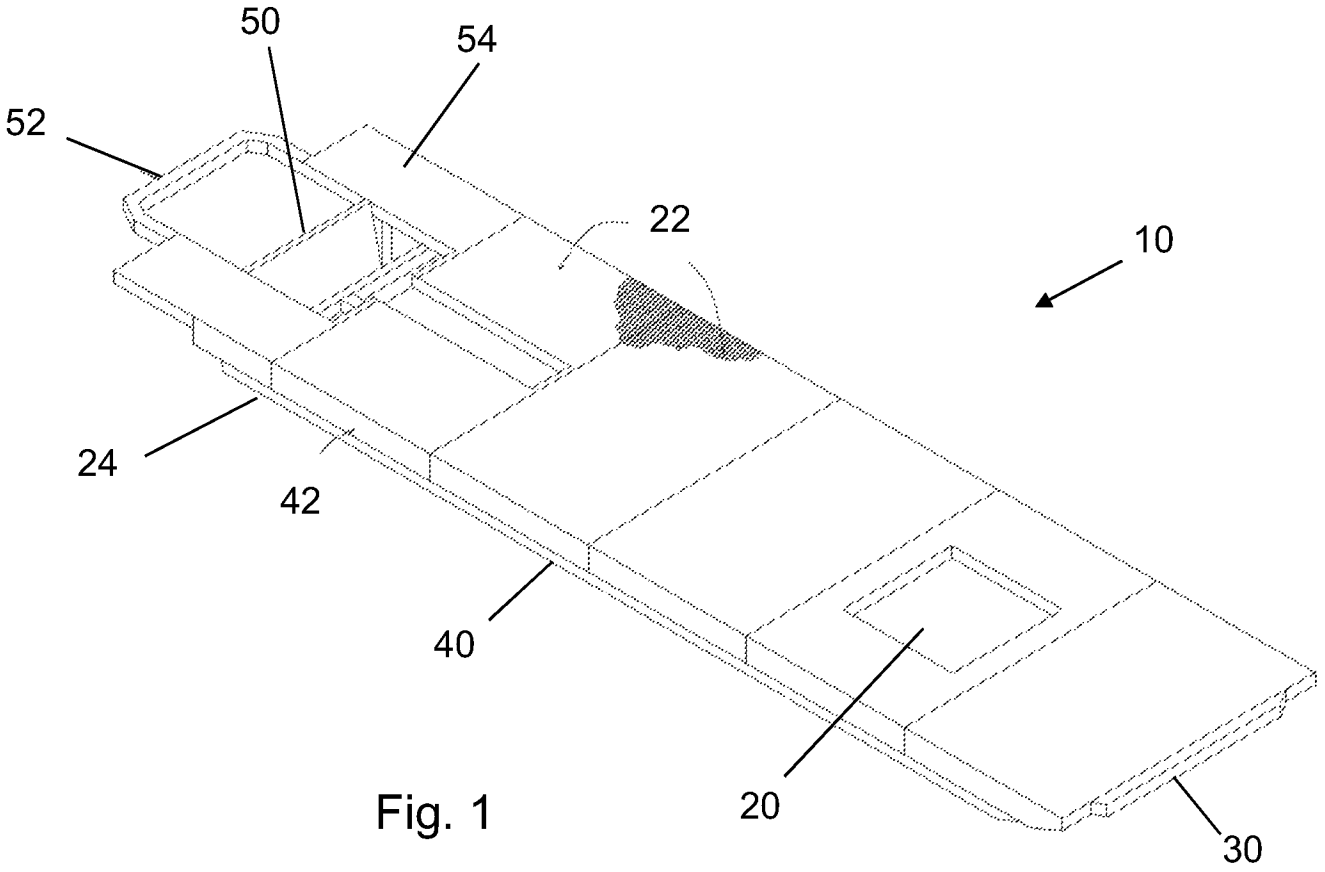
FIG. 1 is a perspective view of a flat bottom boat according to an embodiment of the invention.

Flat bottom boats are particularly popular for use in relatively shallow water because the relatively small draft of the flat bottom boats enables the flat bottom boats to go closer to shore than is possible using other types of boats. For example, the draft of a typical 27 foot pontoon boat is about 12 inches whereas the draft of a flat bottom boat having a similar length is about 8 inches. The decreased draft of the flat bottom boat also provides the flat bottom boat with the ability to move at a faster speed than a comparably equipped pontoon boat.

An important element of the flat bottom boat is the stepped hull. The stepped hull substantially eliminates drifting that is typically experienced by prior art flat bottom boats. Drifting causes the prior art flat bottom boats to laterally shift while moving through the water. The drifting also makes is difficult to steer the prior art flat bottom boats.

The stepped hull enables the flat bottom boat to perform similar to a tri-toon pontoon boat. For example, when the stepped hull boat is operated at higher speeds, the flat bottom boat banks nicely during turns and displaces water away from the side of the boat in contrast to a typical flat bottom boat that causes the displaced water to come almost straight up. The flat bottom boat also exhibits an enhanced ability to hold its position in the wind and waves. These stepped hull benefits make the flat bottom boat much easier to operate.

An embodiment of the invention is directed to a flat bottom boat as illustrated at 10 in the associated figures. The flat bottom boat 10 may be adapted for a variety of applications. An example of one potential use of the flat bottom boat 10 is for supporting a lifting mechanism that is used in conjunction with moving dock sections.

It is possible to adapt the flat bottom boat 10 in a variety of sizes based upon the intended use. The flat bottom boat 10 may have a width of between about 4 feet and about 12 feet. In certain embodiments, the flat bottom boat 10 has a width of 8 feet.

The flat bottom boat 10 may have a length of between about 6 feet and about 30 feet. In certain embodiments, the flat bottom boat 10 has a length of between about 20 feet and about 30 feet. The flat bottom boat 10 may have a depth of up to about 3 feet. In certain embodiments, the flat bottom boat 10 has a depth of about 2 feet.

The flat bottom boat 10 generally includes a frame 12 (illustrated in FIGS. 4-11) to which a cover material is applied. The frame 12 includes a plurality of frame members that are interconnected to provide the flat bottom boat 10 with sufficient rigidity. The number and size of the frame members may be selected based upon a variety of factors such as the length and width of the flat bottom boat 10.

In certain embodiments, the frame 12 includes primary frame members 32, secondary frame members 34 and tertiary frame members 36. The primary frame members 32 may have a greater strength than the secondary frame members 34 and the tertiary frame members 36. The greater strength of the primary frame members 32 may result from at least one of a height of the primary frame members 32, a depth of the primary frame members 32 and a wall thickness of the primary frame members 32.

In certain embodiments, the primary frame members 32 substantially extend around an outer edge of the frame 12. In other embodiments, there is at least one primary frame member 32 positioned intermediate the front and back of the frame 12 that extend between opposite sides of the frame 12. In still other embodiments, there is at least one primary frame member 32 that is oriented generally parallel to the sides of the frame 12. The secondary frame members 34 extend between primary frame members 32 intermediate the primary frame members 32.

The tertiary frame members 36 may have a smaller height, depth and/or wall thickness than the secondary frame members 34. In certain embodiments, the tertiary frame members 36 extend between primary frame members 32 and secondary frame members 34.

Figure 2:
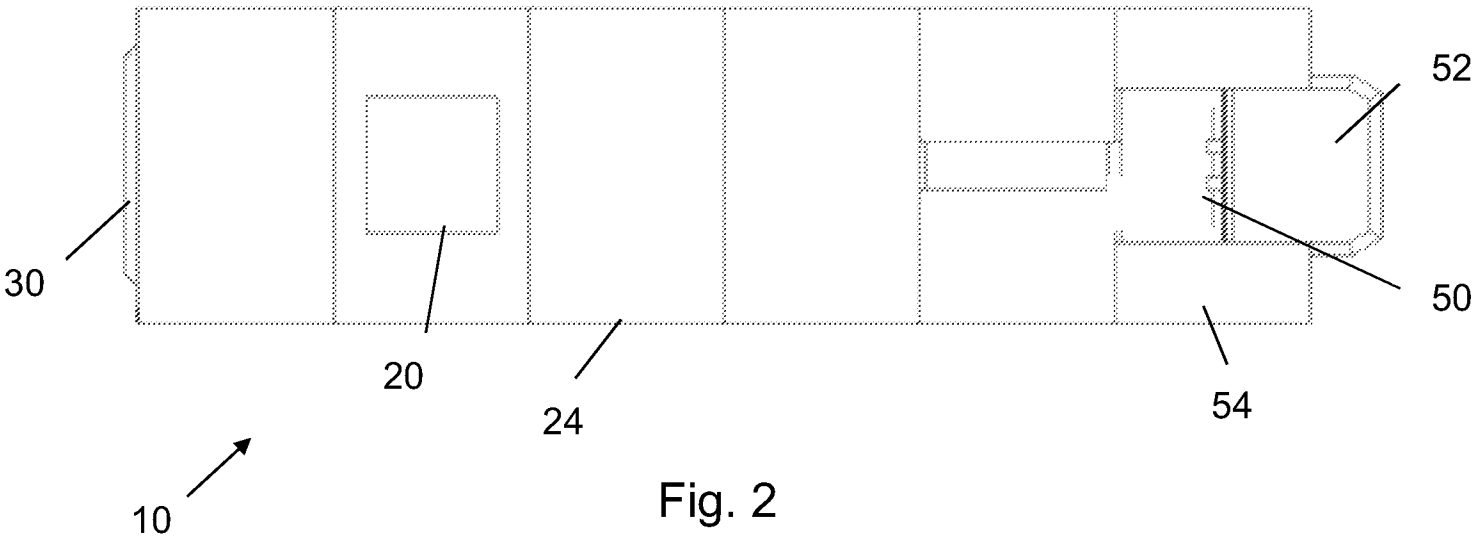
FIG. 2 is a top view of the flat bottom boat.
Figure 3:
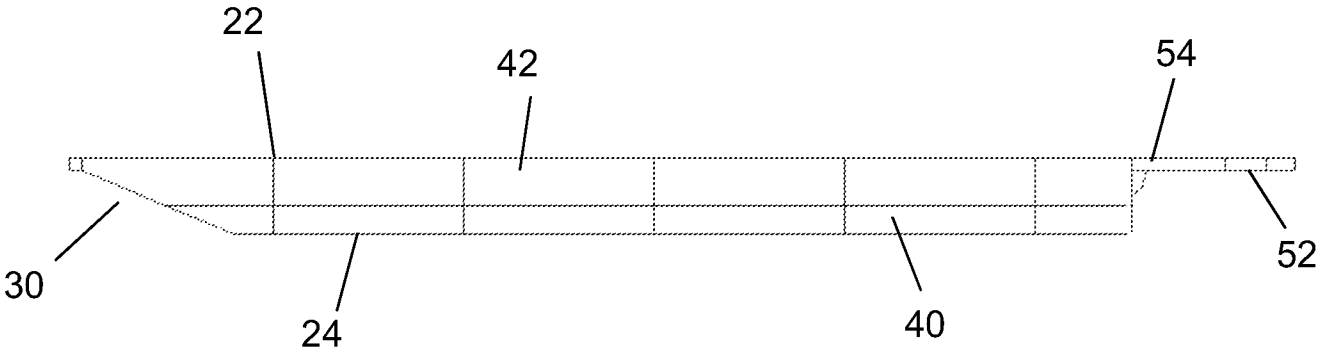
FIG. 3 is a side view of the flat bottom boat.
Figure 4:
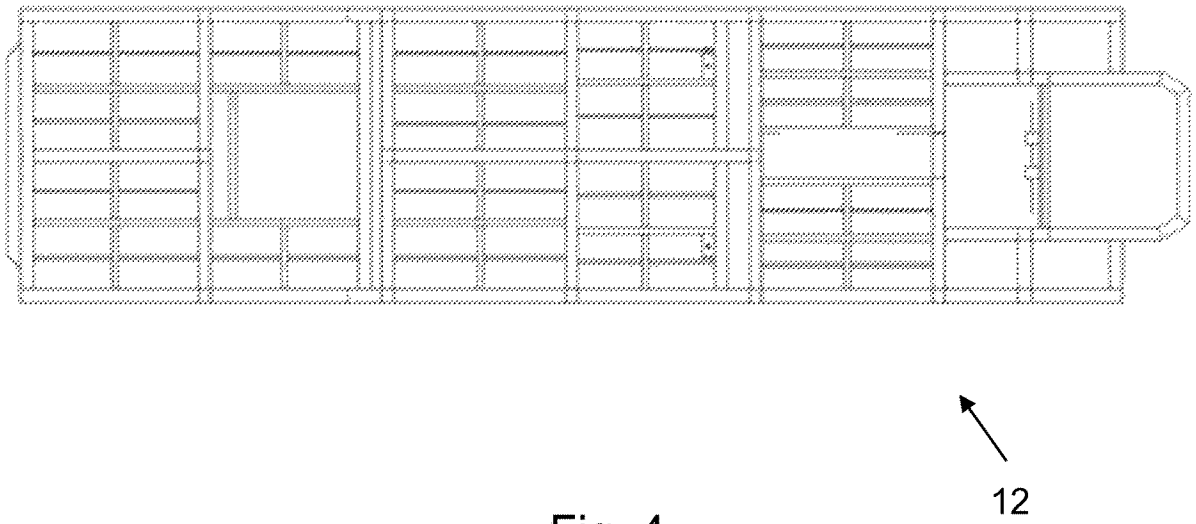
FIG. 4 is a top view of a frame for the flat bottom boat of FIG. 1.
Figure 5:
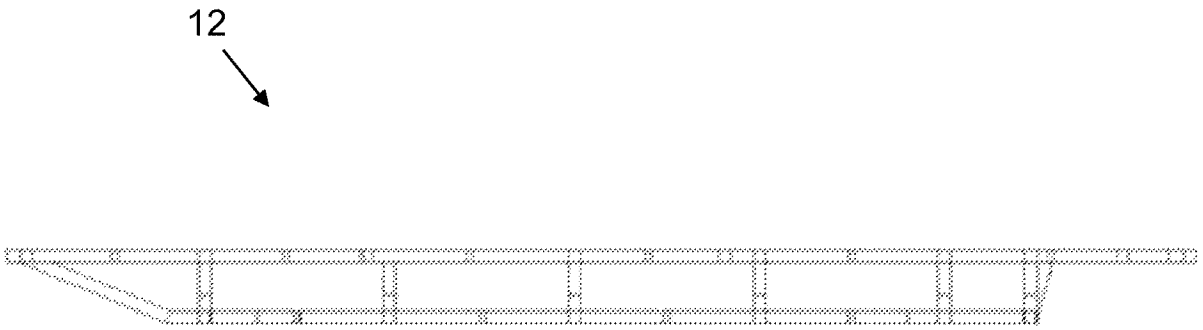
FIG. 5 is a side view of the flat bottom boat frame.
Figure 6:
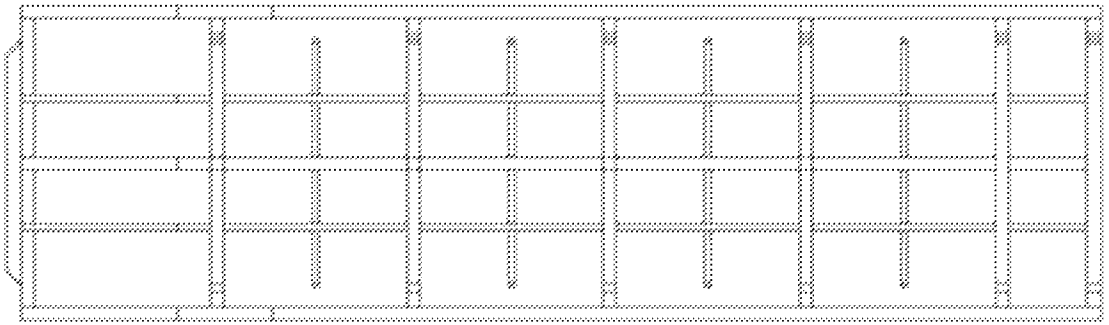
FIG. 6 is a bottom view of the flat bottom boat frame.
Figure 7:
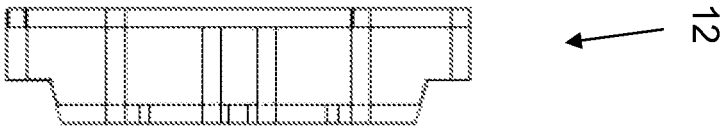
FIG. 7 is a section view of the flat bottom boat taken along a line 7-7 in FIG. 5.
Figure 8:
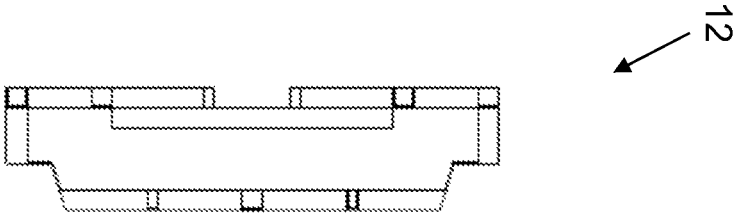
FIG. 8 is a section view of the flat bottom boat taken along a line 8-8 in FIG. 5.
Figure 9:
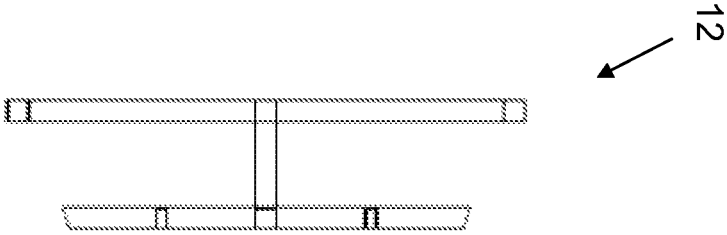
FIG. 9 is a section view of the flat bottom boat taken along a line 9-9 in FIG. 5.
Figure 10:
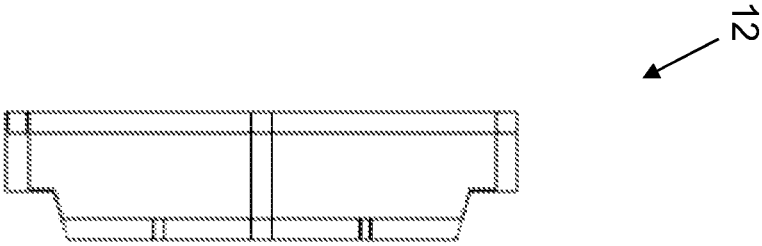
FIG. 10 is a section view of the flat bottom boat taken along a line 10-10 in FIG. 5.
Figure 11:
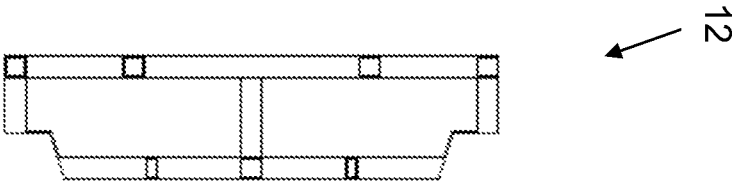
FIG. 11 is a section view of the flat bottom boat taken along a line 11-11 in FIG. 5.

To facilitate such use in a variety of applications, the flat bottom boat 10 may have a generally flat upper surface 22 as illustrated in FIGS. 1-3. The upper surface 22 of the flat bottom boat 10 may have at least one opening 20 formed therein.

The upper surface 22 may be fabricated from a variety of materials depending on the intended use of the flat bottom boat 10. In certain embodiments, the upper surface 22 is fabricated from a metallic material. To reduce the potential of a person slipping on the upper surface 22, the upper surface 22 may have a slip-resistant surface such as a texture that extends over at least a portion of the upper surface.

The lower and side surfaces of the flat bottom boat 10 may be fabricated from a variety of materials depending on the intended use of the flat bottom boat 10. In certain embodiments, the lower and side surfaces of the flat bottom boat 10 are from a metallic material.

The opening 20 may facilitate use of the flat bottom boat in particular applications. As such, the shape and size of such openings 20 may be selected based upon the particular applications. In certain embodiments, the openings 20 are positioned generally intermediate the side surfaces of the flat bottom boat 10.

While the drawings illustrate that a lower surface 24 of the flat bottom boat 10 is substantially flat, it is possible to adapt the concepts of the invention such that at least a portion of the lower surface 24 of the flat bottom boat 10 is not substantially flat. For example, the lower surface 24 may have a convex shape or a concave shape.

A front surface 30 of the flat bottom boat 10 may be generally flat and oriented at an angle with respect to the lower surface 24 of the flat bottom boat 10. In certain embodiments, the angle is an obtuse angle. The angle may be between about 145 degrees and about 160 degrees.

Orienting the front surface 30 at this angle enables the flat bottom boat 10 to get into a plane configuration as the flat bottom boat 10 moves through the water as compared to flat bottom boats 10 that have a vertically oriented front surface as such a configuration causes the flat bottom boat to plow through the water. The invention thereby enhances the rate at which the flat bottom boat 10 can move through the water.

While the drawings illustrate that the front surface 30 is substantially linear when moving between the opposite sides of the flat bottom boat 10, it is possible to adapt the concepts of the invention so that the front surface 30 is not substantially linear.

The sides of the flat bottom boat 10 each have a stepped configuration. Proximate a lower hull portion 40 thereof, the flat bottom boat 10 has a width that is less than a width proximate an upper hull portion 42 thereof.

In certain embodiments, the upper hull portion 42 constitutes at least 50 percent of the height of the flat bottom boat 10. In other embodiments, the upper hull portion 42 constitutes between 60 and 70 percent of the height of the flat bottom boat 10.

A side of the flat bottom boat 10 in the upper hull portion 42 may be oriented generally perpendicular to the upper surface 22 of the flat bottom boat 10. A side of the flat bottom boat 10 in the lower hull portion 40 may be oriented at an angle with respect to the lower surface 24 of the flat bottom boat 10. In certain embodiments, the angle between the side and the lower surface 24 is between about 60 degrees and about 80 degrees.

In certain embodiments, a width of the stepped region 28 on each side of the flat bottom boat 10 is between about 5 percent and about 15 percent of a width of the flat bottom boat 10. In other embodiments, the width of stepped region 28 on each side of the flat bottom boat 10 is about 10 percent of the width of the flat bottom boat 10.

The width of the stepped region 28 on each side of the flat bottom boat 10 is between about 70 percent and about 130 percent of a height of the stepped region 28 from a lower surface of the flat bottom boat 10. In other embodiments, the width of the stepped region 28 is about the same as the height of the stepped region 28 from the lower surface of the flat bottom boat 10.

A distance that the lower hull portion 40 is stepped back from the upper hull portion 42 is between about 6 inches and about 12 inches. In certain embodiments, the lower hull portion 40 is stepped back from the upper hull portion 42 about 9 inches.

Proximate a back end of the flat bottom boat 10, a motor mount 50 is provided to facilitate attachment of a conventional outboard motor. It is also possible to adapt the flat bottom boat 10 in conjunction with alternative types of motors.

The flat bottom boat 10 also includes a motor guard 52 that extends around at least a portion of the region where the motor will be mounted. The motor guard 52 thereby reduces the potential of objects coming into contact with the motor as such contact could result in damage to the motor and/or damage to the objects that come into contact with the motor.

The flat bottom boat 10 also includes a splash guard 54 that extends from the back end of the flat bottom boat 10 that minimizes the potential of water being splashed onto the flat bottom boat 10 from the motor as well as water movements caused by the movement of the flat bottom boat 10.

The splash guard 54 may include a side surface that is generally aligned with the side of the flat bottom boat 10. The splash guard 54 extends towards the center of the flat bottom boat 10 and be as close as possible to the motor while not interfering with the movement and operation of the motor. An important feature of the splash guard 54 is for use in conjunction with downriggers (not shown) that are used to steady the flat bottom boat 10 when a lifting apparatus (not shown) is mounted on the flat bottom boat 10.

The splash guard 54 extends a distance from the back end of the flat bottom boat 10 that is sufficiently long to minimize the potential of water splashing onto the surface of the flat bottom boat 10. The splash guard 54 may have a length of at least 1 foot. In certain embodiments, the splash guard 54 has a length of about 2 feet.

In operation, a motor is operably attached to the flat bottom boat 10 and used to propel the flat bottom boat 10 in the water. The structure of the flat bottom boat 10 enhances the stability of the flat bottom boat 10 while also minimizing the potential of water splashing onto the surface of the flat bottom boat 10.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A flat bottom boat comprising:

an upper hull portion having a first width and a lower surface; and a lower hull portion having a second width that is less than a first width, wherein the lower hull portion extends from a lower edge of the upper hull portion, wherein a lower surface of the lower hull portion is substantially flat and wherein a height of the upper hull portion comprises between about 60 and 70 percent of a combined height of the upper hull portion and the lower hull portion.

2. The flat bottom boat of claim 1, wherein the upper hull portion comprises a first side surface and a second side surface that is opposite the first side surface and wherein the lower hull portion is stepped from the first side surface and the second side surface to define a first stepped region and a second stepped region.

3. The flat bottom boat of claim 2, wherein the first stepped region is approximately equal to the second stepped region.

4. The flat bottom boat of claim 2, wherein a width of each of the first stepped region and the second stepped region is between about 5 percent and about 15 percent of a width of the upper hull portion.

5. The flat bottom boat of claim 2, wherein a width of each of the first stepped region and the second stepped region is between about 70 percent and about 130 percent of a height of the lower hull portion.

6. The flat bottom boat of claim 1, wherein the upper hull portion comprises a side surface and an upper surface and wherein the side surface is substantially perpendicular to the upper surface.

7. The flat bottom boat of claim 1, wherein the lower hull portion has a side surface and wherein an angle between the side surface and the lower surface is between about 60 degrees and about 80 degrees.

8. The flat bottom boat of claim 1, wherein the lower hull portion has a side surface and wherein a height of the side surface is about one-half of a difference between the first width and the second width.

9. The flat bottom boat of claim 1, wherein at least one of the upper hull portion and the lower hull portion comprise a front surface that is oriented at an obtuse angle with respect to the lower surface of the lower hull portion.

10. The flat bottom boat of claim 1, and further comprising:

a motor mount proximate a back end of the upper hull portion, wherein a motor is attachable to the motor mount; and a splash guard that extends from the back end of the upper hull portion on at least one side of the motor mount.

11. A flat bottom boat comprising:

an upper hull portion having a first width, a lower surface, a first side surface and a second side surface that is opposite the first side surface; and a lower hull portion having a second width that is less than a first width, wherein the lower hull portion extends from a lower edge of the upper hull portion, wherein a lower surface of the lower hull portion is substantially flat, wherein the lower hull portion is stepped from the first side surface and the second side surface to define a first stepped region and a second stepped region, wherein the first stepped region is approximately equal to the second stepped region and wherein a height of the upper hull portion comprises between about 60 and 70 percent of a combined height of the upper hull portion and the lower hull portion.

12. The flat bottom boat of claim 11, wherein a width of each of the first stepped region and the second stepped region is between about 5 percent and about 15 percent of a width of the upper hull portion.

13. The flat bottom boat of claim 11, wherein a width of each of the first stepped region and the second stepped region is between about 70 percent and about 130 percent of a height of the lower hull portion.

14. The flat bottom boat of claim 11, wherein the lower hull portion has a side surface, wherein an angle between the side surface of the lower hull portion and the lower surface of the lower hull portion is between about 60 degrees and about 80 degrees and wherein a height of the side surface of the lower hull portion is about one-half of a difference between the first width and the second width.

15. A flat bottom boat comprising:

an upper hull portion having a first width and a lower surface; and a lower hull portion having a second width that is less than a first width, wherein the lower hull portion extends from a lower edge of the upper hull portion, wherein a lower surface of the lower hull portion is substantially flat, wherein the upper hull portion comprises a first side surface and a second side surface that is opposite the first side surface, wherein the lower hull portion is stepped from the first side surface and the second side surface to define a first stepped region and a second stepped region, wherein a width of each of the first stepped region and the second stepped region is between about 70 percent and about 130 percent of a height of the lower hull portion and wherein a height of the upper hull portion comprises between about 60 and 70 percent of a combined height of the upper hull portion and the lower hull portion.

16. The flat bottom boat of claim 15, wherein a width of each of the first stepped region and the second stepped region is between about 5 percent and about 15 percent of a width of the upper hull portion.

17. The flat bottom boat of claim 15, wherein the lower hull portion has a side surface and wherein an angle between the side surface of the lower hull portion and the lower surface of the lower hull portion is between about 60 degrees and about 80 degrees.

18. The flat bottom boat of claim 15, wherein at least one of the upper hull portion and the lower hull portion comprises a front surface that is oriented at an obtuse angle with respect to the lower surface of the lower hull portion.

* * * * *